United States Patent [19]

Matsushita

[11] 4,001,936

[45] Jan. 11, 1977

[54] CARPET CUTTER

[75] Inventor: Katsumi Matsushita, Sakai, Japan

[73] Assignee: Kabushiki Kaisha Toa Interia (Toa Interior Co., Ltd.), Osaka, Japan

[22] Filed: Nov. 14, 1975

[21] Appl. No.: 631,958

[30] Foreign Application Priority Data

Nov. 21, 1974 Japan ..... 49-134566

[52] U.S. Cl. ..... 30/287; 30/293

[51] Int. Cl.[2] ..... B26B 29/00

[58] Field of Search ..... 30/287, 293, 294, 286

[56] References Cited

UNITED STATES PATENTS

| | | | |
|---|---|---|---|
| 3,363,314 | 1/1968 | O'Brien | 30/287 X |
| 3,395,453 | 8/1968 | Prater | 30/293 |
| 3,737,932 | 6/1973 | Armijo | 30/293 X |
| 3,844,038 | 10/1974 | Kelly | 30/293 |
| 3,934,341 | 1/1976 | Carlson | 30/287 |
| 3,934,342 | 1/1976 | Matsushita | 30/293 |

*Primary Examiner*—Al Lawrence Smith
*Assistant Examiner*—J. C. Peters
*Attorney, Agent, or Firm*—George B. Oujevolk

[57] ABSTRACT

A carpet cutter is disclosed which is used to cut any excess edges of a carpet to the size of a room after it has been laid in the room. The carpet is cut at its bend toward the wall. It includes a bed plate slid on the carpet, a guide plate at front of the bed plate to be pressed against the wall, a slanting blade mounting plate in the rear of the guide plate, a pair of blades mounted on the blade mounting plate, and a pair of presser rollers disposed outside of the blades for pressing down the carpet against the floor just before cutting. The carpet is cut by one blade slantly mounted so as for its edge to butt on the wall surface. The clamping nuts for the blades are tightened in reverse direction to each other. Therefore, there is no fear of the blade coming loose by contact with the carpet during cutting. The position of the presser rollers can be adjusted by means of one adjusting mechanism provided in the center according to the thickness of the carpet. This enables the cutter to cut a carpet of any thickness with simple adjustment.

4 Claims, 6 Drawing Figures

CARPET CUTTER

This invention relates to an improvement in a carpet cutter used for cutting a carpet and other similar floorings to the size or configuration of a room after it has been laid on the floor.

In laying a carpet or other floorings (hereinafter generally called a carpet) in a room, a carpet slightly larger than the size of the room is laid on the floor and any excess portions are cut off from its four sides just to the size or shape of the room by use of this carpet cutter.

A carpet cutter of this kind has been disclosed by my U.S. Pat. application Ser. No. 501,866, now U.S. Pat. No. 3,934,342 in which the carpet is cut at its bend from the floor toward the wall, simply by pushing forward the carpet cutter along the corner, so as to be installed with its cut edge butting on the wall surface.

The aforementioned prior art carpet cutter comprises a guide plate constituting the front edge of a bed plate which is slid on the carpet, a slidable plate provided in the rear of the guide plate with an adjustable slanting angle, an opposed pair of blades mounted on a blade mounting plate secured on said slidable plate, and an opposed pair of rollers mounted outside of their corresponding blades so that their vertical position is independently adjustable.

On the prior art carpet cutter, the slidable plate was provided with means for adjusting the cutting angle of the blades according to the kind and thickness of the carpet to be cut. This made the carpet cutter very complicated in construction and resulted in high production cost and insufficient durability.

But, experiments have shown that the angle of the blades does not have to be changed according to the carpet to be cut and that the optimum cutting result is achieved even with a fixed cutting angle. Such as cutting angle for satisfactory result has been proved to be from 37° to 40° with respect to the bed plate.

The former carpet cutter had a further shortcoming that the adjustment of vertical position of the rollers according to the carpet to be cut was very troublesome because the rollers were adapted to be adjusted independently.

It is an object of the present invention to provide an improved carpet cutter which does not have such shortcomings in construction and which has simple mechanism and has a longer service life.

It is another object of the present invention to provide a carpet cutter which permits adjustment of position of both rollers at one central position, thus being much easier to use.

It is a further object of the present invention to provide a carpet cutter so adapted that the carpet comes in contact with the blade clamping nut during cutting in such a direction that the latter is further tightened, thus eliminating the possibility of the blades coming loose or off.

Other objects and features of the present invention will become apparent from the following description with reference to the accompanying drawings, in which.

Figure 1:
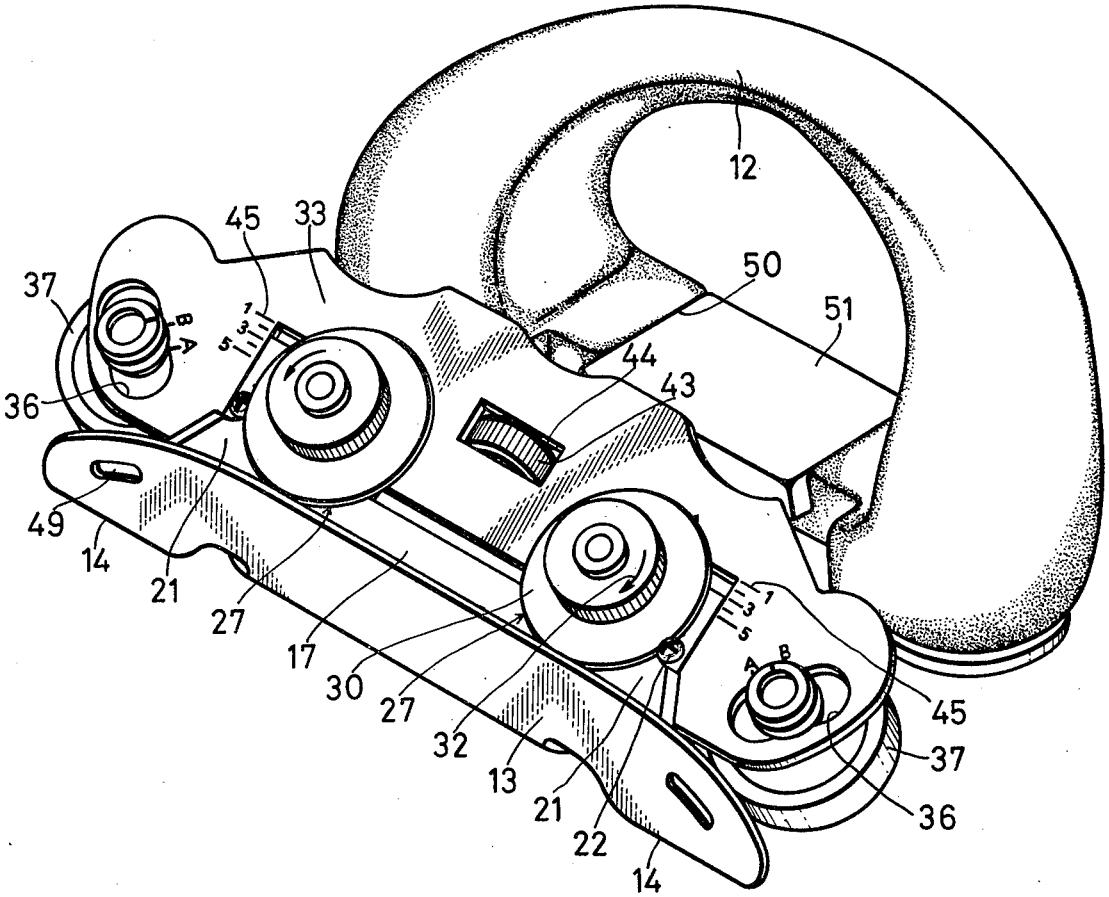
FIG. 1 is a perspective view of an embodiment of the present invention.

Referring to the drawings, numeral 11 designates a bed plate sliding on the carpet, said bed plate having a flat bottom and being formed with an arcuate notch at each end thereof so as to be the narrowest at the center thereof.

To the upper surface of the bed plate 11 is secured an operating grip 12 to extend along its rear edge. The bed plate 11 terminates in an oblong guide plate 13 rising from its front edge with its ends extending beyond the corresponding ends of the bed plate 11.

Figure 4:
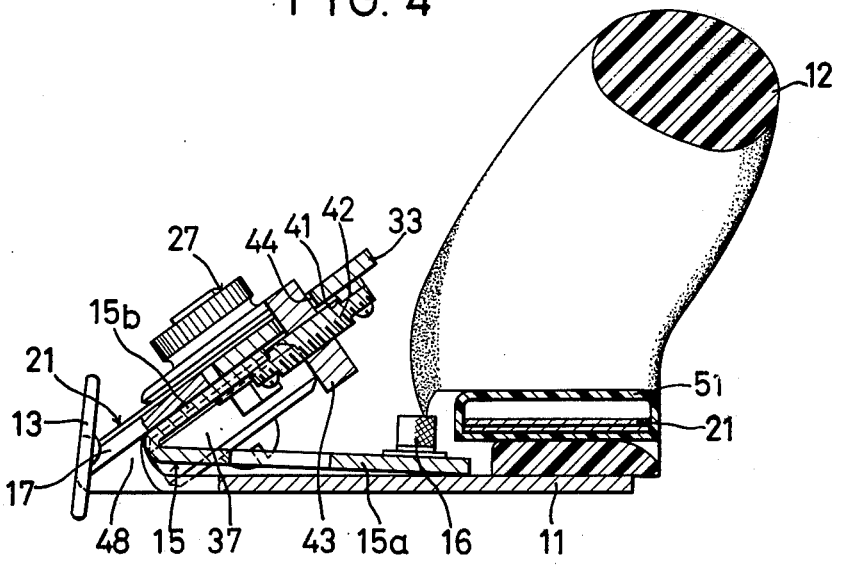
FIG. 4 is a vertical sectional side view thereof.

The guide plate 13 is not vertical but slightly leans toward the grip 12 as shown in FIG. 4 with its bottom front adapted to be slid along and against the corner defined by the floor A′ and the wall B′.

The guide plate 13 has its ends formed to be arcuate and have the lower straight edge projecting downward slightly beyond the underside of the bed plate 11 to form a carpet push-in portion 14.

A slanting plate 15 is mounted in the rear of the guide plate 13 on the bed plate 11 in the center thereof with its front end adjacent to the guide plate 13.

As will be seen from FIG. 4, the slanting plate 15 comprises a metal plate bent into two portions, that is, a base portion **15*a* and a slanting portion 15*b*. The former portion is put on the bed plate 11 with the bend adjacent to the guide plate 13 and is secured by bolts 16 to the bed plate 11** at its rear portion.

The angle of the slanting portion **15*b***, which is also that of blades described later, is preferably from 37° to 40° with respect to the horizontal plane.

The slanting portion **15*b* is shorter than the guide plate 13. On the slanting portion 15*b* is laterally mounted an oblong blade mounting plate 17** at its lower front portion.

The blade mounting plate 17 is of a length substantially equal to that of the slanting portion **15*b*. It is formed with a rectangular notch 18 in its center along the upper edge thereof. The blade mounting plate 17 is secured to the slanting portion 15*b* at each side of the notch 18 by means of flanged stud bolts 19 and 19** fixed in the latter.

Thus, the blade mounting plate 17 is slant to the same extent as the slanting portion **15*b* with its portions at each side of the notch 18 providing a mounting surface for blades 21. Each mounting surface is provided with the stud bolt 19 having a flange 23 at its base and a projection 22 constituted by a screw fixed therein outside of the stud bolt 19, as shown in FIG. 3**.

Figure 3:
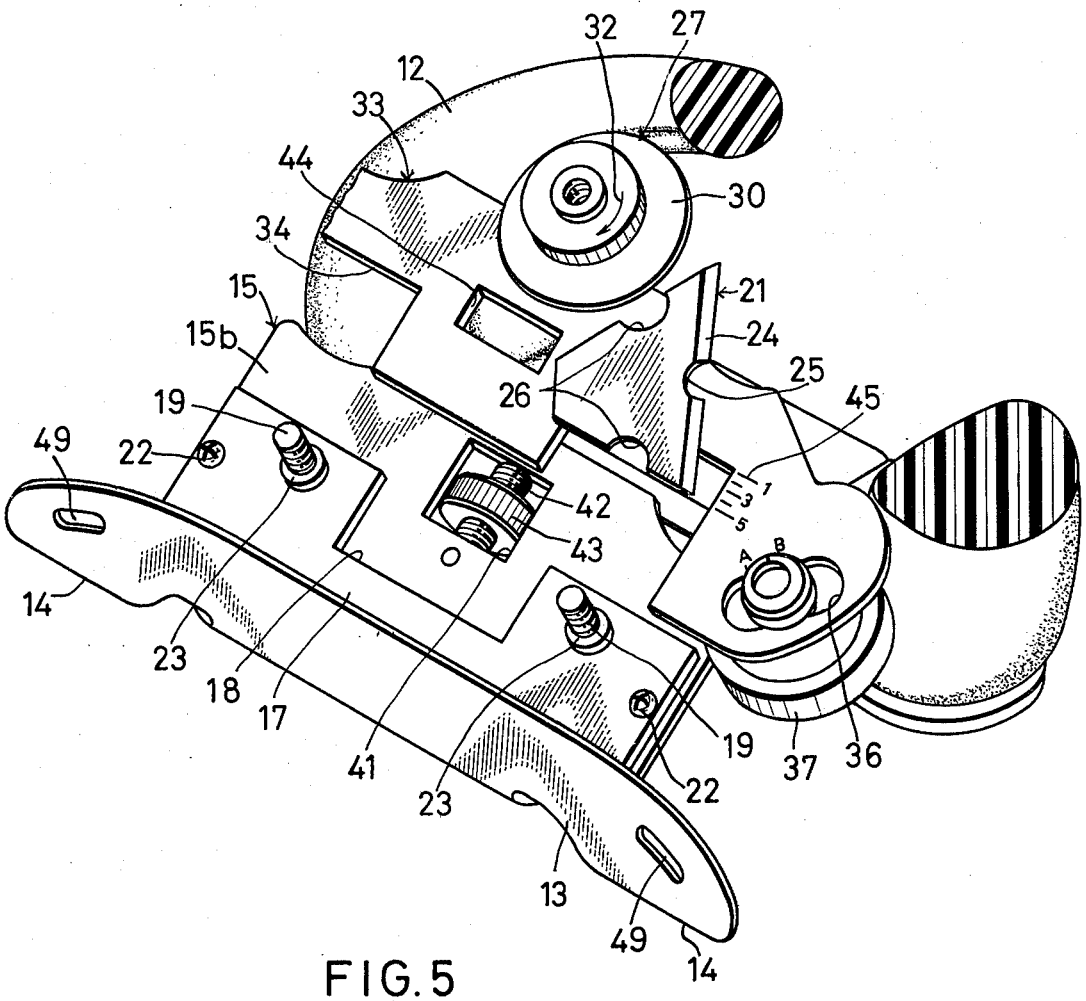
FIG. 3 is a partially cutaway exploded perspective view thereof.

The blade 21, which is mounted on the blade mounting plate 17, is in the form of a trapezoid with its sides gradually narrowing from one end forming a blade edge 24 to the other end parallel thereto as shown in FIG. 3. Halfway of the blade edge 24 is formed a semi-circular notch 25 for receiving the projection 22. Each of the two oblique sides also has a semi-circular notch 26 formed intermediately of its length to receive the flange 23.

Each blade 21 is mounted on the blade mounting plate 17 with the projection 22 received in the notch 25 and the flange 23 received in the notch 26 so that the lower end of the blade edge 24 projects obliquely and outwardly beyond the end of the blade mounting plate 17.

Each blade 21 is mounted with its lower side butting on the rear surface of the guide plate 13 to keep the carpet from entering between the blade and the guide plate. By turning the blade 21 upside down, the blade edge 24 is usable at either side of the notch 25.

After having been properly set on the blade mounting surface, the blades 21 are secured by tightening clamping nuts 27 on the stud bolts 19. Each clamping nut 27 is provided with a flange 30 of a large diameter below its knob, said flange securely holding the blade 21 when the clamping nut 27 is tightened.

The stud bolt 19 at one side is threaded in a direction reverse to the one at the other side. Each clamping nut 27 has a threaded hole complementary to the thread on the corresponding stud bolt 19. The threading direction of the stud bolt 19 is determined to ensure that the force by contact of the carpet with the clamping nut 27 during cutting acts in such a direction as to further tighten said nut. In other words, the righthand stud bolt 19 in Flg. 5 is right-handed screw while the lefthand one is left-handed screw. On each clamping nut 27 is marked an arrow 32 to indicate its tightening direction for easy operation.

In the underside of each clamping nut 27 is formed a circular recess (not shown) around the threaded hole to receive the flange 23, thereby ensuring secure clamping of the blade 21.

On the slanting portion 15*b* is transversely mounted an oblong roller mounting plate 33 at its upper rear portion to be longitudinally slidable therealong. The roller mounting plate 33 is slightly longer than the guide plate 13 and has its lower edge shaped to have such a contour as to fit the upper edge of the blade mounting plate 17. The sliding movement of the roller mounting plate 33 is precisely guided by the longitudinal sliding surface on the blade mounting plate 17.

The roller mounting plate 33 has its ends extending beyond the ends of the blade mounting plate 17 and formed to be arcuate. The carpet is to be inserted into the space 35 between the lower edge of the roller mounting plate 33 at its projecting end and the guide plate 13.

The roller mounting plate 33, which is of a thickness substantially equal to that of the blade mounting plate 17, is clamped against the slanting plate 15 when the clamping nuts 27 are tightened to secure the blades 21.

The roller mounting plate 33 has an arcuatey inclined slit 36 formed therein at each end thereof to rotatably mount an opposed pair of presser rollers 37 on the back side thereof.

An internally threaded stud with a large head is mounted through each slit 36 from over to be displaceable therein but unrotatable. The presser roller 37 constituted by a bearing is mounted with a washer on the lower end of the stud projecting beyond the underside of the roller mounting plate 33 and a holding screw 39 is screwed into said lower end to hold the roller 37 in position. The position of each roller 37 is adjustable in the slit 36 over the whole length thereof by loosening the holding screw 39. This adjustment of the roller position is a rough adjustment made according to the thickness of the carpet to be cut.

In the center of the slanting plate 15 is provided fine adjusting means for sliding the roller mounting plate 33 up and down according to the thickness of the carpet. In the top center of the slanting portion 15*b* is formed a square hole 41 in which a threaded shaft 42 is secured to extend longitudinally in the center thereof. An adjusting ring 43 is screwed on the threaded shaft 42 to partially protrude beyond the upper surface of the slanting portion 15*b*, said adjusting ring moving up and down the threaded shaft 42 guided thereby when it is manually turned.

The roller mounting plate 33 also is provided in its center with a square hole 44 of a sufficient size to pass the adjusting ring 43 therethrough, said ring partially protruding beyond the upper surface of the roller mounting plate 33.

As the adjusting ring 43 is turned with a finger on the protruding portion, it causes the roller mounting plate 33 to slide up and down, thus moving the rollers in a corresponding direction in a plane parallel to the top surface of the slanting portion 15*b*.

The thicker the carpet is, in the upper position are placed the rollers 37, and vice versa. The position of the roller mounting plate 33 is indicated by the upper edge of the blade mounting plate 17 on graduations 45 provided on the roller mounting plate 33.

As described above, rough adjustment according as the material to be cut is a carpet of ordinary thickness or an especially thin carpet is effected by displacement of the studs in the slits 36. Adjacent to the slits 36 and on the studs themselves are engraved graduations A and B to indicate the position for carpets of ordinary thickness and that for especially thin carpets, respectively.

Figure 2:
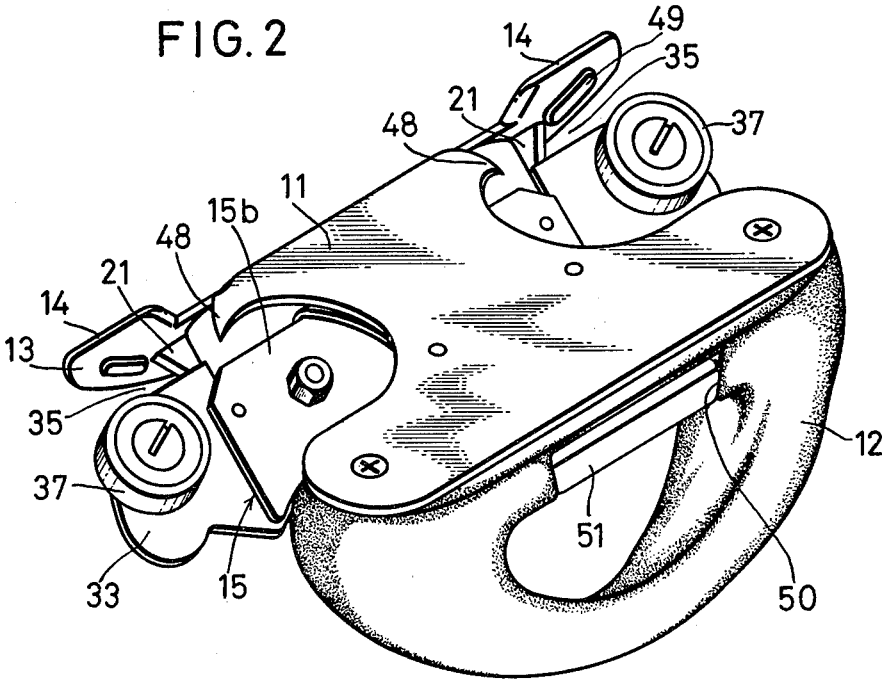
FIG. 2 is a perspective view of the same turned upside down.

As shown in FIG. 2, the bed plate 11 has its opposite ends at front formed to warp arcuately upward at an acute angle to form a carpet guide portion 48 which after cutting, guides the edge of the carpet under the bed plate 11 so as to be held down by the carpet push-in portion 14.

The guide plate 13 is also provided with a projection 49 adjacent to each end thereof to project rearward from its back surface to prevent the carpet from invading between the guide plate 13 and the blade 21.

The grip 12 is provided with a longitudinal open-top recess 50 at its base where it is secured to the bed plate 11. It is convenient to mount a case 51 for spare blades in the recess 50.

The operation of the preferred embodiment will be described below.

First, the adjusting ring 43 is turned up or down to bring the roller mounting plate 33 to a suitable position for the carpet to be cut. The blades 21 are then set on the blade mounting plate 17 and the clamping nuts 27 are tightened to secure the blades 21 and the roller mounting plate 33.

Next, a carpet C is laid on the floor A′ with its excessive edge resting against the wall B′. The carpet cutter thus adjusted is placed on the carpet C with the guide plate 13 butting against the wall. The bend portion of the carpet where it rises from the floor toward the wall is then inserted into the space 35 between the guide plate 13 and the roller mounting plate 33.

Figure 6:
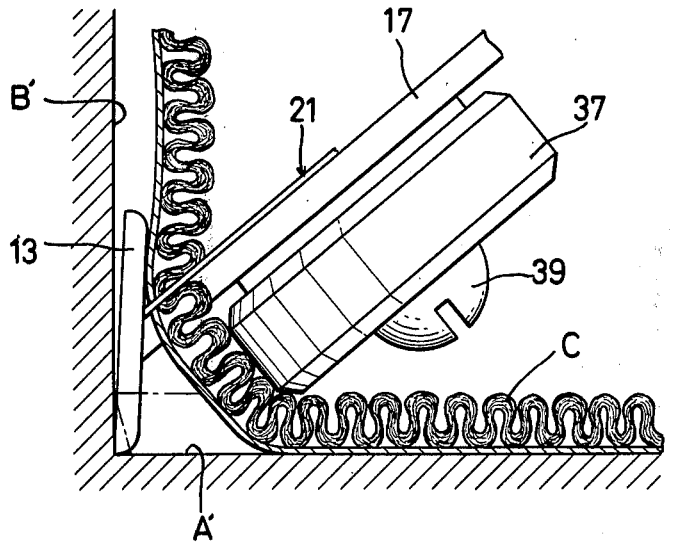
FIG. 6 is an enlarged fragmentary side view, showing the same in use.

The presser roller 37 at the leading end is now pressing down the carpet C against the floor at its bend (FIG. 6). The carpet cutter is pushed forward on the carpet C in this condition while pressing the guide plate 13 against the wall B′. At its slides thereon, the carpet C is cut by the blade 21 as shown in FIG. 6.

It will be understood from FIG. 6 that the blade 21 cuts the carpet obliquely at its bend. This ensures secure cutting of the carpet at its base material portion.

The edge of the carpet at the installed side will be of an oblique cross-section with its top butting on the wall and its bottom away from it.

Said edge of the carpet at the installed side is smoothly guided by the guide portion 48 into under the bed plate 11. After the carpet has been cut at the bend, the edge of the carpet is spread by the underside of the bed plate 11 so as to butt on the wall as shown by an alternate long and short dash line in FIG. 6.

Figure 5:
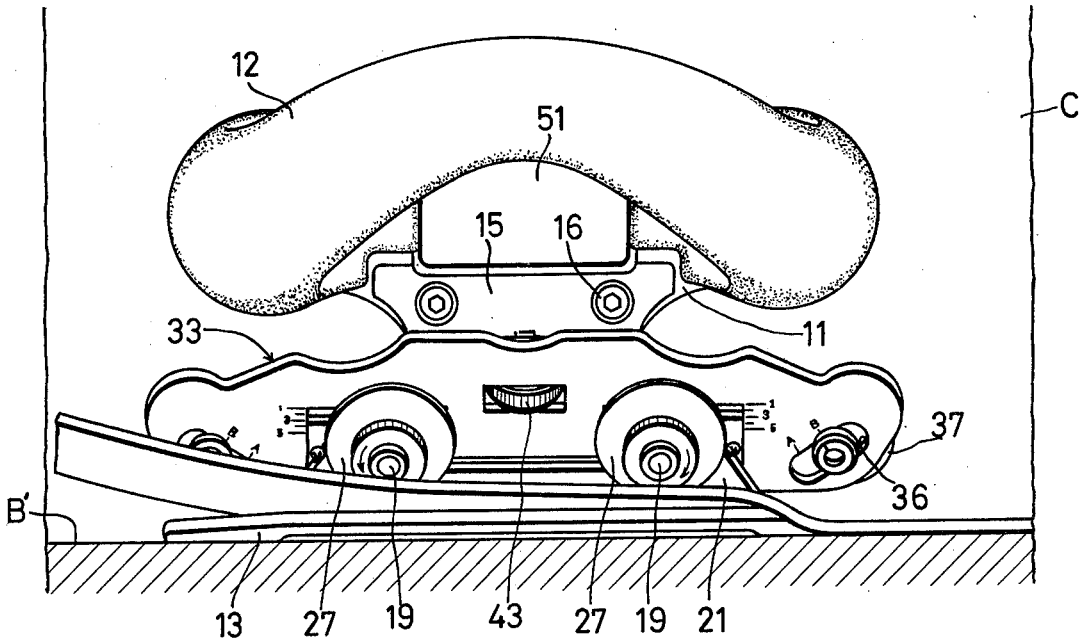
FIG. 5 is a plan view thereof, showing the same in use.

The cut-off narrow strip is guided to the rear of the guide plate 13 as illustrated in FIG. 5. This cut-off strip comes in contact with the clamping nut 27 at the leading end (that is, the righthand one in FIG. 5) only in such a direction as to tighten the latter so that the blade 21 cannot come loose.

Furthermore, the cutting of the carpet is finished by a single pass of the carpet cutter due to the fact that the edge of main body of the carpet is pushed into the corner by the carpet push-in portion 14 of the guide plate 13 at the trailing end thereof as the cutter moves on.

It will be understood from the foregoing description that the carpet cutter according to the present invention is capable of cutting a carpet precisely so as for its edge to butt on the wall, simply by moving it along the side wall. The carpet cutter is also easier to use because the position of both presser rollers can be adjusted by means of a single adjusting means provided at center.

Because of the tightening direction for one blade clamping nut 27 reverse to that for the other, there is no possibility of the blades coming loose. This ensures smooth and safe cutting.

Since the blades are secured in a fixed inclined position and the position of both rollers are controlled at a single central point, this carpet cutter is simpler in construction, which results in reduced manufacturing cost and longer service life.

What is claimed is:

1. A carpet cutter for cutting a carpet to the size or configuration of a room comprising:

a bed plate adapted to be slid on the carpet, a grip fixedly mounted on said bed plate along the rear edge thereof, a guide plate extending upward from the front edge of said bed plate and having its ends projecting beyond the ends of said bed plate, a slanting plate secured on the bed plate in the rear of said guide plate with its lower front edge adjacent to said guide plate, a blade mounting plate fixedly mounted on said slanting plate at the lower front portion thereof, an opposed pair of cutting blades mounted on said blade mounting plate at the ends thereof, said blades each being secured in position by tightening a clamping nut on a stud bolt projecting from said blade mounting plate, a roller mounting plate mounted on said slanting plate at the upper rear portion thereof above said blade mounting plate to be slidable along the surface of the slanting plate, said roller mounting plate forming with said guide plate a space into which the carpet is inserted for cutting, an opposed pair of presser rollers rotatably mounted on the underside of said roller mounting plate at the ends thereof so as to roll on the carpet during cutting, and roller position adjusting means providing in the center of said slanting plate for sliding said roller mounting plate up and down the slanting plate to adjust the position of said presser rollers according to the thickness of the carpet to be cut.

2. A carpet cutter as claimed in claim 1 wherein said blade clamping nut at one end is tightened when turned in a direction reverse to that for the one at the other end, whereby the carpet comes in contact with the blade clamping nut at the cutting side only in such a direction as to tighten the same.

3. A carpet cutter as claimed in claim 1 wherein said roller position adjusting means comprises a threaded shaft longitudinally secured in a hole formed in said slanting plate and an adjusting ring mounted on said threaded shaft to move up and down guided thereby when turned, said roller mounting plate being provided with an opening to allow said adjusting ring to pass therethrough so as to partially project from the upper surface thereof.

4. A carpet cutter as claimed in claim 1 wherein said presser rollers each are mounted on the roller mounting plate by means of a stud mounted in a slit formed therein at each end thereof so as to be displaceable in said slit over the whole length thereof according to the thickness of the carpet to be cut.

* * * * *